US010805747B2

(12) United States Patent
Thumm et al.

(10) Patent No.: US 10,805,747 B2
(45) Date of Patent: Oct. 13, 2020

(54) METHOD OF CUSTOMIZING A HEARING DEVICE COMPONENT, A HEARING DEVICE COMPONENT AND A HEARING DEVICE

(71) Applicant: Sonova AG, Stafa (CH)

(72) Inventors: Natasha Thumm, Wetzikon (CH); Christoph Weder, Dudingen (CH); Markus Muller, Mannedorf (CH); Erdal Karamuk, Mannedorf (CH); Petra Gunde, Zurich (CH); Anuja Gopal Shirole, Fribourg (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/465,652

(22) PCT Filed: Dec. 1, 2016

(86) PCT No.: PCT/EP2016/079408
§ 371 (c)(1),
(2) Date: May 31, 2019

(87) PCT Pub. No.: WO2018/099562
PCT Pub. Date: Jun. 7, 2018

(65) Prior Publication Data

US 2020/0029161 A1 Jan. 23, 2020

(51) Int. Cl.
*H04R 25/00* (2006.01)

(52) U.S. Cl.
CPC ..... *H04R 25/658* (2013.01); *H04R 25/652* (2013.01)

(58) Field of Classification Search
CPC .. H04R 25/00; H04R 1/1016; H04R 2225/77; H04R 25/658; H04R 1/1066; H04R 2460/15; H04R 25/652; H04R 5/033
(Continued)

(56) References Cited

U.S. PATENT DOCUMENTS 9,179,211 B2 11/2015 Kirkpatrick
2002/0129819 A1* 9/2002 Feldman ..... A61B 17/12022 128/831

(Continued)

FOREIGN PATENT DOCUMENTS

WO 02/060498 A1 8/2002

OTHER PUBLICATIONS

International Search Report for PCT/EP2016/079408 dated Jul. 7, 2017.

(Continued)

*Primary Examiner* — Norman Yu
(74) *Attorney, Agent, or Firm* — Pearne & Gordon LLP

(57) ABSTRACT

A method of customizing a component of a hearing device to the ear of a hearing device user. The method includes the steps of providing the hearing device component as a pre-form including a shape-memory material, heating the hearing device component, and bringing the hearing device component in contact with at least a portion of the ear after reaching a pre-set contact temperature such that the hearing device component conforms to the individual shape of the at least a portion of ear. The shape of the hearing device component is fixed by attending a hardening time of the shape-memory material. Therefore, the hearing device component perfectly fits to the geometry of the user's ear canal.

27 Claims, 11 Drawing Sheets

(58) Field of Classification Search
USPC ..... 381/328, 380, 322, 329; 181/135
See application file for complete search history.

(56) References Cited

U.S. PATENT DOCUMENTS

| | | | | |
|---|---|---|---|---|
| 2015/0119238 | A1* | 4/2015 | Pretsch | B42D 25/415 503/204 |
| 2015/0146909 | A1* | 5/2015 | Kirkpatrick | H04R 25/652 381/380 |
| 2015/0360030 | A1* | 12/2015 | Cartledge | A61N 1/36036 607/60 |
| 2016/0295311 | A1* | 10/2016 | Keady | H04R 25/652 |

OTHER PUBLICATIONS

Written Opinion for PCT/EP2016/079408 dated Jul. 7, 2017.
Lendlein et al., "Shape-Memory Polymers", Angew. Chem. Int. Ed. 41, 2002, pp. 2034-2057.
Liu et al., "Review of progress in shape-memory polymers", Journal of Materials Chemistry, 17, 2007, pp. 1543-1558.
Mather et al., "Shape Memory Polymer Research", Annual Reviews of Material Research, 39, 2009, pp. 445-471.
Hager et al., "Shape memory polymers: Past, present and future developments", Progress in Polymer Science, 4950, 2015, pp. 3-33.
Zhao et al., "Recent progress in shape memory polymer: New behavior, enabling materials, and mechanistic understanding", Progress in Polymer Science, 2015, 49-50, 2015, pp. 79-120.

* cited by examiner

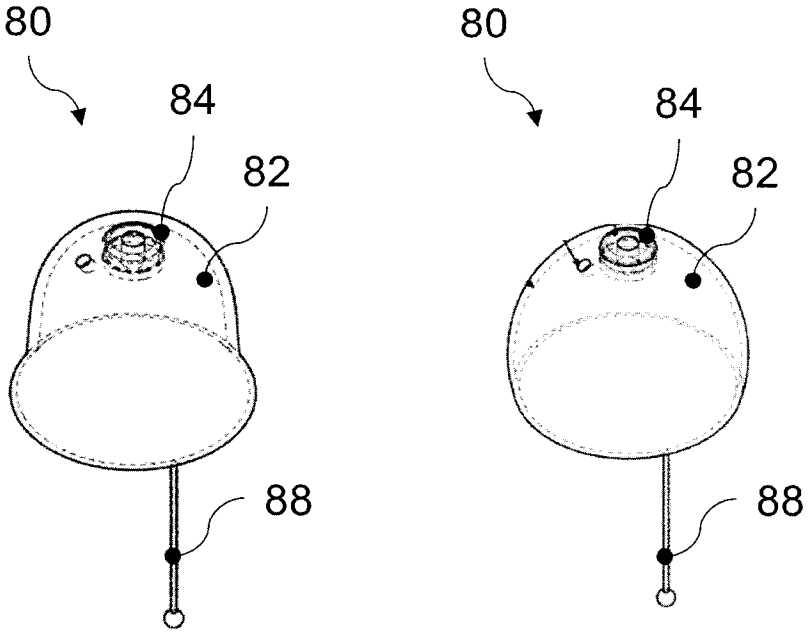
Fig. 9a
Fig. 9b
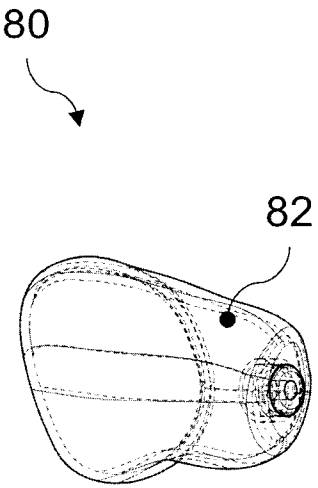
Fig. 9c
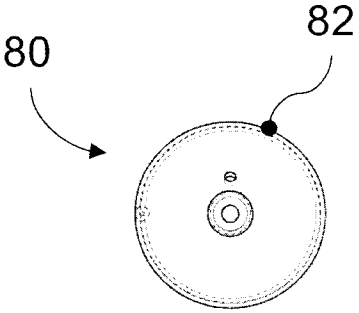
Fig. 9d
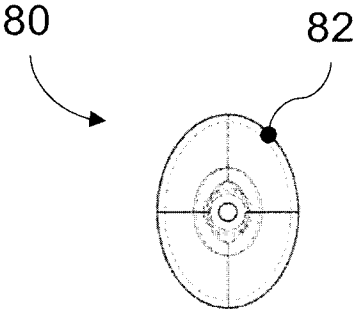
Fig. 9e

METHOD OF CUSTOMIZING A HEARING DEVICE COMPONENT, A HEARING DEVICE COMPONENT AND A HEARING DEVICE

TECHNICAL FIELD

The present invention is related to a method of customizing a hearing device component, a hearing device component and a hearing device.

BACKGROUND OF THE INVENTION

Hearing devices are typically used to improve the hearing capability or communication capability of a user. A hearing device may pick up the surrounding sound with a microphone of the hearing device, process the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

The acoustic coupling of a hearing device or rather a component thereof, e.g. an in-ear-part of the hearing device, also called an earpiece, to the ear is of great importance regarding the acoustic performance of the hearing device and also the wearing comfort thereof. The term 'acoustic coupling' describes the use of physical components to bring amplified and/or processed sound from e.g. a hearing aid to the eardrum of a user of a hearing aid. Those components usually comprise for example earmolds, earpieces, domes, hearing aid shells which all can be custom made or standard sized. The use of those components usually includes their insertion into the outer ear by the user of a hearing aid. As the anatomy of the ear canal differs widely between individuals it is known to customize the in-ear-part of the hearing device such that the in-ear-part fits to the geometry of the user's ear canal. However, some of the disadvantages of customization are the price, the tolerance chain due to the various process steps at different places, or the time to delivery. A further problem is that the patient has to come in for a second appointment and if there is an issue (e.g. leakage, not comfortable) he may need to come a third time. This also bears disadvantages for the fitter, as it e.g. jams his/her schedule.

Another known method is to provide earpieces made from soft materials (e.g. silicone) in standard geometry and sizes such that the earpieces adapt passively to the geometry of the individual's ear canal. The disadvantage of the soft parts is their variability in acoustic attenuation on the same ear and between different ears due to the non-ideal fit to complex and non-averaged canal geometries.

Document U.S. Pat. No. 9,179,211 B2 describes an earpiece which is heatable to achieve a moldable condition which allows reconfiguration of the external surface by engagement with the outer ear (e.g. concha) in order to dispose the external surface in a fixed configuration in conformity to the outer ear. The proposed solution has the drawback that the hot material is brought into direct contact with the users skin which may hurt the user. Therefore, this method might solely be applicable to the concha and is not applicable to the ear canal which is very heat sensitive. Another drawback is that the material needs to be pressed to the concha by hand, which can be unhandy. A further drawback can be that the fitting time is rather short as the material solidifies rapidly after e.g. reaching room or body temperature. This can result in an incorrect shape of the earpiece. A final drawback is the fact that the prior art material is freely shapeable when hot, and it is therefore easy to destroy the shape of the prior art earpiece by excessive deformation or heating.

It is therefore an object of the present invention to provide a method of customizing a component of a hearing device, a hearing device component and a hearing device solving the disadvantages in the prior art.

SUMMARY OF THE INVENTION

The present invention is directed to a method of customizing a component of a hearing device to an ear of a hearing device user, comprising the steps of: a) providing said hearing device component as a pre-form comprising a shape-memory material; b) heating said hearing device component beyond a first transition temperature to a malleable condition; c) keeping said hearing device component unengaged and/or uncoupled with said ear for a time interval sufficient for said hearing device component to cool down to a pre-set contact temperature, while said hearing device component retains said malleable condition; d) after reaching said pre-set contact temperature, bringing said hearing device component in contact with at least a portion of the ear of said hearing device user such that said hearing device component conforms to the individual shape of said at least a portion of the ear; e) fixing said shape of said hearing device component by attending a hardening time of said shape-memory material.

The achieved malleable condition mentioned above means a condition that allows mechanically deforming at least a portion of said hearing device component into a temporary shape. The present invention involves the usage of a hearing device component made of a shape-memory material, such as a shape memory polymer (SMP). It is well known in the art that polymers can be bestowed with shape-memory characteristics by combining the effect of rubber elasticity with a switching element that can be addressed to enable (i.e., during programming or erasing a temporary shape) or prevent (i.e., while or after a temporary shape is fixed) elastic deformation. Rubber elasticity is typically imparted via a network structure that involves covalent or physical cross-links, whereas a phase transition in the polymer can be used as the switch. On the basis of these simple design guidelines, a plethora of different shape-memory polymers has been developed (for examples that are included by reference see: Lendlein et al. *Angew. Chem. Int. Ed.* 2002, 41, 2034. Liu et al. *J. Mater. Chem.* 2007, 17, 1543. Mather et al. *Annu. Rev. Mater. Res.* 2009, 39, 445. Hager et al. *Prog. Polym. Sci.* 2015, 49-50, 3-33, and Zhao et al. ibid. 79-120. The most widely used SMPs are thermally switchable SMPs, in which the glass transition of an amorphous phase or the melting of crystalline domains are employed as switching element.

The properties of thermoplastic shape memory polymers, which are used in preferred embodiments of the present invention, can be schematically described as follows. At high temperature, that is above a temperature that herein is referred to as a "second transition temperature", the material is in a liquid melted state and can be shaped by standard melt-processing techniques, for example, but not limited to, injection molding and extrusion processes. Cooling the material below said second transition temperature after shaping leads to solidification. Objects thus obtained are commonly referred to as having a permanent shape, herein we also use the term pre-form to describe objects that contain parts made from SMPs having a permanent shape. In the temperature range below said second transition but above the phase transition temperature of the element that is used as the switch, the material is elastic. Under these conditions an object made from the SMP can be deformed by mechanical force to a temporary shape, but upon removal of the force, the original permanent shape is largely restored. When an object made from the SMP is deformed by mechanical force to a temporary shape in the temperature range below said second transition but above the phase transition temperature of the element that is used as the switch and cooled to a temperature below said phase transition temperature with applied mechanical force, the temporary shape can largely be fixed, that is, the fixed temporary shape is largely retained after the force is removed, as long as the temperature is kept below said phase transition temperature. If the object is heated again above said phase transition temperature, the original permanent shape is largely restored. In the above the term largely is used to indicate that the various shape transformation steps are often not perfect, so that the extent of fixation or the recovery of the permanent shape may not be quantitative. This is well known in the art and for many applications, including embodiments of the present invention, fully acceptable. Thus, the language used herein should not be construed to mean perfect or quantitative transformation between the various shapes.

In the context of the present invention, we define as the "first transition temperature" the temperature above which an SMP or an object comprising an SMP is in a condition that allows mechanical deformation into a temporary shape, which can largely be fixed into a fixed temporary shape. In some SMPs that are used in embodiments of the present invention, a phase transition such as the glass transition of a glassy phase or the crystal-melt transition of a (semi) crystalline phase of the SMP are used as the switch, and the "first transition temperature" matches with the temperature where the phase transition occurs. To avoid any confusion, the "first transition temperature" of a given SMP or object shall be determined upon heating the SMP or object from below said first transition temperature.

In many cases, the phase transition temperature of the phase used for shape fixing in an SMP does not depend on the direction of the temperature change and the same phase transition temperature is observed in heating and cooling experiments, but in some cases, different phase transition temperatures are observed. Materials that display different phase transition temperatures are useful for embodiments of the present invention, as they permit cooling an SMP or an object comprising an SMP below the first transition temperature while the SMP or the object comprising an SMP retains the condition that allows mechanically deforming at least a portion into a temporary shape.

In many cases, the phase transition of the phase used for shape fixing in an SMP is rather fast, but in some cases, the phase transition is slower. Materials that display a slow phase transition are useful for embodiments of the present invention, as they permit cooling an SMP or an object comprising an SMP below the first transition temperature while the SMP or the object comprising an SMP retains, at least for a period that depends on the speed of the phase transition at the given temperature, the condition that allows mechanically deforming at least a portion into a temporary shape. This allows fixing the temporary shape of a shape-memory polymer or an object comprising a shape memory polymer into a fixed temporary shape at a temperature below the first transition temperature by simply attending a hardening time.

The possibility to shape a shape memory polymer into a temporary shape at a temperature below the first transition temperature, that is at a "pre-set contact temperature", before it eventually is fixed in the fixed temporary shape is advantageous in the context of the present invention, as the hearing device component of the present invention is allowed to contact the user's skin when reaching a temperature which does not hurt the user, for example body or room temperature, but it is still in a condition that allows mechanically deforming at least a portion of said hearing device component into a temporary shape. In an example, the pre-set contact temperature can range from room temperature to body temperature. In an example, attending a hardening time of said shape-memory material can comprise letting said shape-memory material harden against said at least a portion of the ear.

In an embodiment of the proposed method, said hearing device component comprises at least one of an earpiece, a sound tube, a cable and a retention element.

In an embodiment of the proposed method, said first transition temperature is above 50° C., preferably in a range of 50° C. to 100° C. The shape-memory material of the hearing device component can be subjected to a temperature cycle involving a peak temperature above 50° C. to 100° C. (e.g. 60° C.) and at the end of the temperature cycle, when the shape-memory material again reaches room temperature but is still soft, the hearing device component can easily be shaped to the anatomy of the users' ear.

In an embodiment of the proposed method, said pre-set contact temperature is a room temperature or a temperature dependent on the tolerance of the body of said hearing device user. In other words, the hearing device component is shaped precisely to the individuals anatomy of the hearing device user after running through the temperature cycle, wherein the skin contact temperature is such to feel comfortable to the user. Therefore, the hearing device component, while it retains the malleable condition, keeps a temperature which does not hurt the user's skin.

In an embodiment of the proposed method, the providing step a) comprises the step of: manufacturing at least a portion of said pre-form of said hearing device component from a shape-memory material, comprising the steps of: liquefying said shape-memory material by heating it to a temperature above a second transition temperature and shaping it into a primary shape that will become part of said at least a portion of said pre-form, and solidifying said primary shape upon cooling to a temperature below said given second transition temperature and preferably below said first transition temperature.

Therefore, injection molded or extruded standard-sized hearing device component pre-forms made of shape-memory material can be prepared. Said pre-forms can be imparted a defined shape. In an example, a new pre-form can be made in a secondary operation by heating the injection molded pre-form above the first transition temperature and shape it to another shape, e.g. make it smaller or more tapered to better fit into the ear.

In an embodiment of the proposed method, said second transition temperature is in a range of 60° C. to 250° C., preferably in a range of 150 to 250° C.

In an embodiment of the proposed method, said shape-memory material—once heated above the first transition temperature and cooled down to said pre-set contact temperature which can be e.g. room or body temperature—keeps a tendency to recover to said primary shape at, and below, said pre-set contact temperature, such that said hearing device component exerts a restoring force on said at least a portion of the ear of said hearing device user to allow for a conformal adaptation of said hearing device component to said at least a portion of the ear of said hearing device user. The hearing device component made of the shape-memory material thus allows an anatomical individualization or customization of the shape by simply heating and letting it cool down to e.g. room temperature. The customization of the shape of the hearing device component takes place after cooling down of the material and during a time duration of e.g. a few minutes when the material is still soft and before it again reaches its initial rigidity.

In an embodiment of the proposed method, said time interval upon cooling during which said hearing device component retains said malleable condition is a pre-set time delay to reach said pre-set contact temperature before hardening into a final shape, said pre-set time delay being designed by adjusting the chemical formulation of said shape-memory material and/or by adding nucleation agents or similar to said shape-memory material. During the pre-set time delay the shape-memory material of the hearing device component gets shaped to the ear, e.g. the ear canal. After a time interval, e.g. a few minutes, the shape-memory material hardens and fixes permanently the enforced shape.

In an embodiment of the proposed method, said pre-set time delay ranges between 30 seconds and 30 minutes.

In an embodiment of the proposed method, the step of bringing said hearing device component in contact with at least a portion of the ear of said hearing device user comprises the step of inserting said hearing device component in an ear canal of the ear of the hearing device user. The adaptation of the hearing device component can take place at the point of sale (POS) during a comfortable time, therefore omitting loss of time. Advantageously, no recurrence is required to the user. However, if needed, the earpiece can also be modified by the user or at a second visit at the POS. Advantageously, the hearing device component can be coupled to the rest of the hearing aid, e.g. before customization, thus making sure that it sits at the optimal place for the respective anatomy of the user.

In an embodiment of the proposed method, making said hearing device component conform to the individual shape of said at least a portion of the ear comprises the step of letting the hearing device component autonomously reconfigure to the shape of said ear canal under said restoring force, after insertion into the ear canal, at least for a part of the conforming process. While inserting the hearing device component in its malleable condition into the ear, the shape-memory material will be deformed. The shape memory effect prevents that the material collapses in the ear. In an aspect, the shape memory effect can force the material to adapt to the individual geometry of the ear canal.

In an embodiment of the proposed method, the step of making said hearing device component conform to the individual shape of said at least a portion of the ear comprises the step of additionally providing said hearing device component with at least one expandable means adapted to enhance a conformal adaptation of said hearing device component to said ear canal. This embodiment can be useful for forming a customizable ear shell as an example of the hearing device component. The ear shell can be a hollow ear shell containing the receiver of the hearing device, e.g. a Receiver-In-Canal (RIC) hearing device.

In an embodiment of the proposed method, said at least one expandable means being removable upon fixing the shape of said hearing device component.

In an embodiment of the proposed method, said at least one expandable means comprises a foam piece. In an example, the foam piece possesses a slow reset force. Said foam piece could be compressed by a fixture or just by rolling it, e.g. between ones fingers. Since the reset force is slow, there is enough time to plug in the foam into the ear shell which is in the malleable condition and insert it into the ear canal. By slowly expanding, the foam piece forces the pliable ear shell to adjust to the ear canal and fixes it while hardening. The foam piece could also have a connector which can be fixed to the customizable ear shell after compressing it, which allows improved handling. The foam piece could also have a receiver dummy inside to ensure enough space will remain for the (ultimate) receiver in a later stage. The foam piece could be disposable or reusable.

In an embodiment of the proposed method, said at least one expandable means comprises an inflatable balloon. The inflatable balloon can be plugged into the customizable ear piece, e.g. by means of a connector of the ear shell. By inflating the balloon the pliable ear shell adjusts to the shape of the ear canal while hardening. The inflatable balloon can either be inflated with liquid or air. The inflating liquid can also be adjusted to a certain temperature to accelerate the hardening. A receiver dummy can be inserted inside the inflatable balloon in order to ensure enough space for the receiver in a later stage.

In an embodiment of the proposed method, said at least one expandable means comprises a spring-like mechanism. This spring-like mechanism can comprise a mechanical spring or flexible lamella mechanism used to adapt the customizable ear shell to the ear canal. After activating the spring-like mechanism inside the ear canal, the pliable shell can be adjusted and hardened. In an example, the spring-like mechanism can contain a spring, a torsion spring or a flexible element, e.g. made from a flexible plastic or metal, which applies forces to the pliable ear shell. The spring mechanism can be a combination of flexible and stiff parts which can be connected with joints in order to improve the conforming process to ear canals with different shapes. While the stiff part ensures to apply enough force, the flexible part adjusts to the shape of the ear canal and distributes the applied force evenly to the surface. The spring mechanism can either be pre-stressed and released inside of the ear shell or relaxed and be stressed by a certain movement in order to activate it inside the ear shell. In a further example, a torsion spring can be stressed and expanded by a twisting movement.

In an embodiment of the proposed method, the step of making said hearing device component conform to the individual shape of said at least a portion of the ear comprises the step of molding and/or pressing the hearing device component into shape by engagement with said ear. In an example, the hearing device component in its malleable condition can be pressed (and temporary fixed) into the ear canal by means of a finger.

In an embodiment of the proposed method, the at least one expandable means is comprised by the hearing device component. The expandable material can be unitary with the shape-memory material or a separate material. The mechanism which can be used to inflate the shell while curing, could be a part of the customizable shell itself and remains in the shell after curing. Such a customizable earpiece with integrated spring mechanism could be manufactured by insert-injection molding or could be assembled.

In an embodiment of the proposed method, the step of fixing the shape of said hearing device component comprises holding said component in place, manually; or by the aid of fastening means configured to attach said component to said at least a portion of the ear. The component can be hold in place manually by an operator or by the user itself. The fastening means can comprise shape-enforcing means, such as adhesive. In another example, the fastening means can comprise one or more sticky patches, which can comprise single-sided or double-sided sticky tapes. Alternatively or as an option, clips can be used. The component can be attached to the at least a portion of the ear during the hardening time of the component, in particular.

In an embodiment of the proposed method, the shape into which said hearing device component has been customized after hardening against said at least a portion of the ear of the hearing device user can be further adjusted by repeating steps b) to e).

In an embodiment the proposed method further comprises the step of applying standard parts to said customized hearing device component.

The present invention is further directed to a hearing device component customizable for acoustic coupling to an ear of a hearing device user, wherein said component is made from a shape-memory material. During customizing of the hearing device component, the shape-memory material thereof is rendered shapeable or brought into a condition that allows mechanically deforming it into a temporary shape upon heating to a degree such that the component can be in-situ shaped into an anatomically suitable shape after reaching a lower temperature with time. The customization can be achieved in short time and on-site, e.g. the point of sale. Hence, no recurrence is required to the user.

In an embodiment the proposed hearing device component is an earpiece comprising a seal which comprises a sound output bore connected to a receiver or a sound tube of said hearing device. Hence, provided is an earpiece providing e.g. improved wearing comfort for the user and correct fit in the ear with appropriate acoustic seal and retention.

In an embodiment of the proposed hearing device component, said seal takes the form of an open-ended sleeve; or the form of a dome-shaped element; or the form of a pre-formed earmold.

In an embodiment the hearing device component comprises a sound tube designed to deliver sound emitted by the hearing device to a tympanic membrane of said ear, wherein said sound tube comprises at least one of a sound tubing system, a tubing and wiring system, and a receiver.

In an embodiment the hearing device component comprises a retention element adapted to engage with at least an outer ear portion of the ear of said hearing device user and attached to a receiver of said hearing device arrangeable in an ear canal of said ear, wherein said retention element is configured to bias against movements of said receiver within said ear canal. The retention element provides better fixation of e.g. the sound tube or audio signal transmission means, e.g. a receiver of a RIC hearing device, in the ear canal. The retention element can reach out towards the concha in order to anchor the position of the sound tube or audio signal transmission means in the canal.

In an embodiment of the hearing device the sound tube is individually repositionable for supporting a safe hold of a behind-the-ear part of the hearing device to the ear of said hearing device user. In an example, the sound tube comprise a sound tubing system or cable for connecting e.g. an earpiece, a receiver, etc. to a hearing device body. According to the embodiment, the sound tube can be customized such to be guided as closely as possible to the ear of the user such to allow proper alignment.

In an embodiment the hearing device component comprises at least one expandable means adapted to enhance a conformal adaptation of said hearing device component to said ear canal. In an aspect, provided is an in-situ customized earpiece shaped precisely such to allow high wearing comfort to the user.

In an embodiment of the proposed hearing device component, the shape-memory material is one of a shape memory polymer, shape memory blend, shape memory composite or a mixture of some of these materials. The shape memory polymer (SMP) includes for example, but not limited to, physically cross-linked poly(ester urethanes) containing two types of physical cross-links, hard segments that serve to provide network points that bestow the material with rubber elasticity and crystallizable soft segments that serve to fix the temporary shape. The formation of the crystalline phase, that is responsible for the fixation can be temperature and time dependent. The time needed to rearrange the crystalline phase can be tuned in the synthesis process by altering the chemical formulation of the material or by adding nucleation agents. A defined time delay in stiffening upon cooling can be realized. The shape-memory material can change its mechanical property from relatively rigid (e.g. ≈92 Shore A) to a softer state (e.g. ≈72 Shore A) upon exposure to a temperature of e.g. above 60° C. and remains pliable or malleable for e.g. several minutes after having cooled down to room temperature.

In a preferred embodiment of the proposed hearing device component, the shape-memory material is Desmopan DP 2795A SMP, a commercially available SMP made by Covestro (formerly Bayer MaterialScience). This segmented poly-urethane features typical hard segments that are formed by the condensation of 4,4'-methylenebis(phenyl isocyanate) (MDI) and 1,4-butanediol, and contains the crystallizable polyester poly(butylene adipate) (PBA) as the soft segment. Crystallization and melting of the latter are used to program and release the temporary shape, in other words this phase transition is used as the switch to fixate the temporary shape. Differential scanning calorimetry (DSC) experiments conducted at rates of 10 degree/min upon cooling show that soft segment crystallization occurs at ca. 6° C., whereas the heating trace shows soft segment melting around 50° C. The material can be brought into a fluid state by heating to ca. 220° C. to 240° C. and it solidifies by cooling to ca. 150° C. Thus, the first transition temperature of this material is ca. 50° C. When heated above this temperature, the material is brought into a condition that allows mechanical deformation into a temporary shape. The temporary shape can rapidly be fixed into a fixed temporary shape by cooling to below ca. 6° C. Gratifyingly, the condition that allows mechanical deformation into a temporary shape is also retained for a period of time when the material is cooled from above the first transition temperature to below the first transition temperature. This state is retained for a limited period of time, even after cooling down to room temperature before fixation sets in and the temporary shape is fixated. The delay in changing its properties from shapeable towards fixated after exposing the material to a temperature cycle can be used to adapt the shape of the hearing device component to a customized geometry. The shape-memory material used in the invention is not limited to Desmopan DP 2795A SMP and its mechanical behavior but can encompass any material and/or derivatives showing a similar stimuli-responsive behavior. Those skilled in the art will appreciate that this particularly desirable behaviour is related to slow crystallization of the PBA segments at temperatures well below the melting temperature of the resulting PBA crystals.

Moreover, the present invention is directed to a hearing device comprising at least one hearing device component for acoustic coupling to an ear of a hearing device user. The hearing device component can be at least one of a customized sound tube or cable, a retention element, an earpiece, e.g. an ear shell, of a hearing device, etc.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is:

FIGS. 9*a*-9*e* schematically depict earpieces in an aspect of the present invention;

DETAILED DESCRIPTION OF THE INVENTION

There is a strong demand in the market for a method to couple in-ear-parts to the user's ear that are custom fit at the point of sale (POS). Such a method is inherently bond to a material that changes its state of rigidity from very soft for easy adaptation to any required geometry to relatively hard for a permanent fixation of the pre-formed geometry.

In the prior art, in order to adapt to various concha geometries of hearing device users, a retention element used to fix a receiver in the ear canal of the user has to be rather soft and short resulting in a non-optimal and only moderate retention force. In addition to the limited retention force users complain about discomfort and pressure marks resulting from the non-ideal compliance of the retention element to the geometry of the concha and from the constant pressure with which the retention element presses against the concha.

Figure 1:
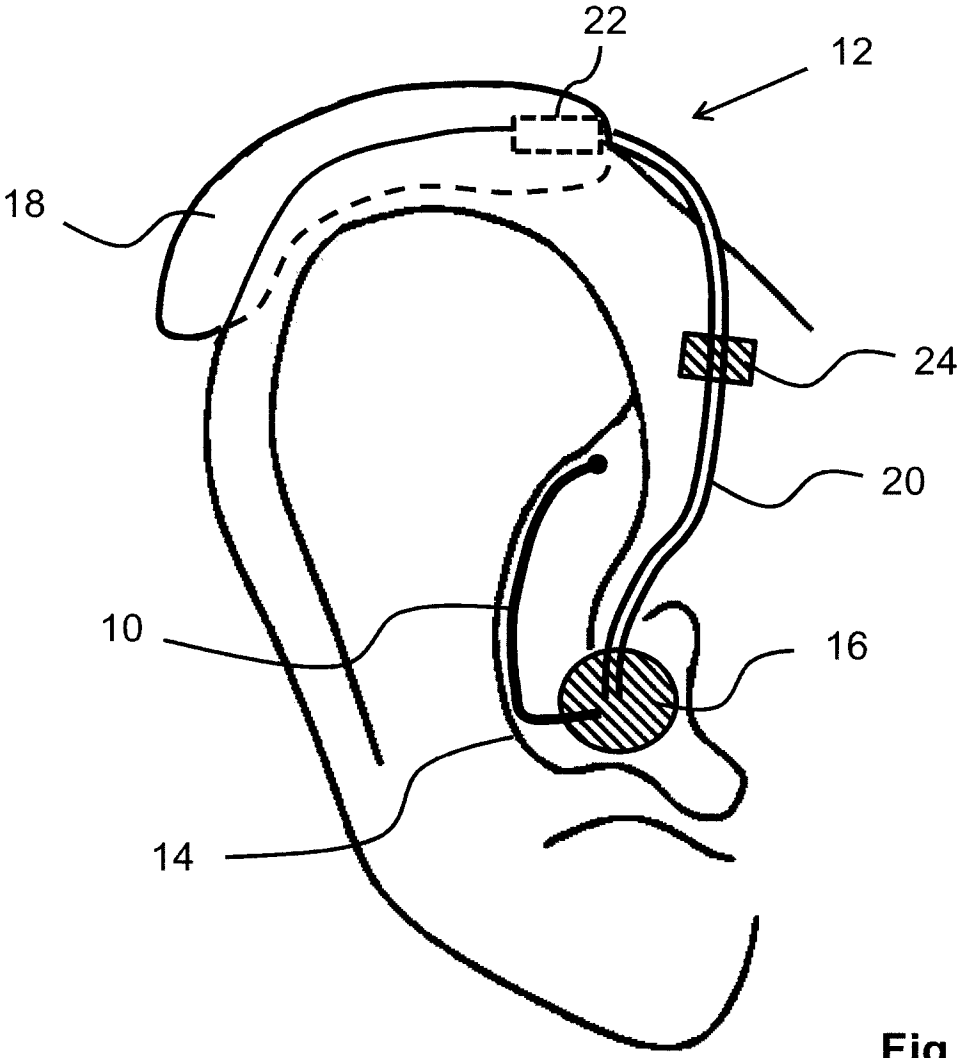
FIG. 1 schematically depicts a hearing device having a customized retention element and a customized sound tube according to an aspect of the present invention.

FIG. 1 schematically shows a customized retention element 10, sometimes called a retention wing, of a hearing device 12, wherein the retention element 10 is formed according to a method in an aspect of the present invention allowing the retention element 10 to perfectly adapt to the size and geometry of the concha 14 of a user. The retention element 10 is attached to an earpiece 16, e.g. a receiver, of the hearing device 12, which, in the shown example, can be an RIC (receiver-in-the-canal) device. The earpiece 16 can be shaped to fit into the ear canal of the user. The hearing device 12 further comprises a hearing device body 18 worn behind the ear of the user. The hearing device body 18 is connected to the earpiece 16 via a sound tube 20 (or cable). The retention element 10 reaches out from the earpiece 16 into the concha 14 and anchors the position of the earpiece 16 in the ear canal. Therefore, the retention element 10 allows better fixation of the earpiece 16 in the ear canal of the user. The spring-like bent of the retention element 10 provides a constant pressure to the concha 14 such that the retention element 10 adapts to a certain extend to the shape of the inner part of the concha 14 preventing the retention element 10 to slip out of the concha 14.

The present invention provides a customization of the shape of the retention element 10 which allows a better fit of the retention element 10 to the individual geometry of the concha 14. Advantageously, no additional pressure force needs to be exerted to the concha 14 that might prevent the retention element 10 from slipping out of the concha 14. During wearing the hearing device 12, the customized retention element 10 does not exert force to the concha 14 and therefore the hearing device user does not feel the presence of the retention element 10. In case the earpiece 16 starts to migrate into or out of the users' ear canal, e.g. during sport activities, the retention element 10 will exert a lateral force to the concha 14 hindering the earpiece 16 from migrating inwards or outwards the ear canal.

According to an aspect of the present invention, the method of customizing the retention element 10 comprises providing said retention element 10 as a pre-form and heating said retention element 10 beyond an elevated temperature, i.e. a first transition temperature, to achieve a malleable condition. The step of providing the retention element 10 as a pre-form comprises using a shape-memory material, e.g. Desmopan DP 2795A SMP, or rather stimuli-responsive polymer having material properties as explained above. Said shape-memory material softens when exposed to the first transition temperature and keeps soft for a while after cooling down to room temperature. The retention element 10 which is made from such shape-memory material allows a customization of the shape by simply heating the retention element 10 above 50° C., preferably in a range of 50° C. to 100° C., more preferably in a range of 60° C. to 80° C., and let it cool down to room temperature.

The retention element 10 is kept unengaged and/or uncoupled with the ear concha 14 for a time interval sufficient for said retention element 10 to cool down to a pre-set contact temperature, while said retention element 10 retains the malleable condition. Said pre-set contact temperature can be room temperature or a temperature dependent on the tolerance of the body of said hearing device user, i.e. a temperature not too hot for the sensitive ear of the user. The time interval upon cooling during which said retention element 10 retains said malleable condition can be a pre-set time delay to reach said pre-set contact temperature before hardening into a final, individually bended (customized) fixed shape. The pre-set time delay can be designed by adjusting a chemical formulation of the shape-memory material and/or by adding nucleation agents or similar to the shape-memory material. In an example, said pre-set time delay ranges between 30 seconds and 30 minutes.

After reaching said pre-set contact temperature, the retention element 10 is brought in contact with the concha 14 of the hearing device user. While keeping or rather (softly) pressing against the concha or rather the cavity in the concha, said retention element 10 is formed or rather individually bended (customized) such to conform to the individual shape of the concha 14. Hence, the customization of the shape of the retention element 10 takes place after cooling down of the material and during a time period of a few minutes during which the shape-memory material is still soft and before it reaches its initial rigidity, also called a hardening time. During this time period the retention element 10 is shaped to the drawn-out cavity in the concha 14 by (softly) pressing the retention element 10 against the cavity in the concha 14. The shape of the retention element 10 is fixed by letting said shape-memory material harden against the cavity in the concha 14.

After a few minutes the shape-memory material hardens and fixes permanently the enforced (bended) shape. In other words, the shape of the retention element 10 is fixed by attending a hardening time of said shape-memory material.

The present invention allows the hearing device user to get a customized retention element 10 within a short time, e.g. a few minutes, at one and the same location, e.g. the point of sale (POS). Further, the customized retention element 10 ideally fits to the shape of the concha 14 and provides an effective retention which prevents the earpiece 16 from migrating out of the ear canal.

According to the present invention, several advantages arise for the hearing device user. Some of said advantages are but are not limited to the earpiece 16 remains stationary, the user can feel secure of not losing the hearing device 12 or a component thereof, e.g. during sport activities, no drawback of discomfort during wearing, etc. The inventive method of customizing further allows in-situ customization of the retention element 10 at a point of sale (POS) which avoids lead time. The customization can be repeated in the case that something went wrong during handling or in the case that the concha 14 of the user changes in size and geometry (pediatric). Several advantages arise for a hearing care professional (HCP) as well. Some of said advantages are but are not limited to additional business opportunity, simple process of customization that does only need a heating source but no special skills, etc.

The heating source mentioned in the section above could be simply a container of warm or hot water, heated in a microwave oven or a water boiler or directly from hot tap water. Alternatively the heating source could be an oven where the component is heated by exposing it to infrared radiation or hot air.

Alternatively or as an option, the sound tube 20 can be customized according to a method in a further aspect of the present invention. The sound is output by the hearing device body 18, e.g. by means of a receiver 22 comprised in the hearing device body 18, wherein the sound is delivered to the earpiece 16 via the sound tube 20. The sound tube 20 is connected to the hearing device body 18 at one end and to the earpiece 16 (e.g. the outer opening thereof) at the other end. The sound tube 20 may have an outer diameter of about 3 mm. While not shown, in a so called Receiver-In-The-Canal (RIC) hearing device, a receiver can be located in the ear canal and connected via a thin cable to the hearing device worn behind the ear.

According to the inventive aspect, the sound tube 20 (or the cable in case of the RIC hearing device) can be customized such to be guided as closely as possible to the ear. Therefore, for different users, the sound tube 20 assumes different forms. In addition, the sound tube 20 conforms not only on the users' physiology but also the shape and type of the hearing device body 18 as well as the nature of the earpiece 16. Further, cosmetic concerns are considered. According to the inventive aspect, the sound tube 20 is made of the shape-memory material as mentioned above. The sound tube 20 softens when exposed to elevated temperature, i.e. the first transition temperature, and keeps soft for a while after cooling down to room temperature. Therefore, in-situ customization of the sound tube 20 can be achieved, wherein the sound tube 20 is subjected to a temperature cycle involving heating by a peak temperature above e.g. 60° C., i.e. the first transition temperature, and subsequently cooling-down to e.g. room temperature. Once the shape-memory material reaches room temperature, the material is still soft such that the sound tube 20 can easily be shaped to the anatomy of the users' ear by e.g. softly pressing against the skin of the user. In other words, the sound tube 20 is shaped to the users' ear after running through the temperature cycle and is shaped to the individual anatomy of the user. Once the sound tube 20 fits to the users' anatomy, the sound tube 20 can be hold in place manually until the shape-memory material assumes its (initial) rigidity. In another example, the sound tube 20 can temporarily be hold in place with the help of a fastening means. Said fastening means may be one or more sticky patches 24. The sticky patch 24 can comprise a single-sided or double-sided sticky tape. The fastening means may also be a clip, which is temporarily attached at the head of the user. The fastening means may be an elastic or a clamp (both not shown). While only some examples are mentioned the fastening means is configured to attach said component to said at least a portion of the ear. The sound tube 20 keeps the enforced shape permanently until the shape-memory material might be subjected to another temperature cycle.

Hence, the present invention allows customizing the sound tube 20 which is less visible and provides improved wearing comfort due to a perfect fit to the users anatomy. Since the customization can take place at the point of sale (POS), the user does not suffer lead time. The customization can be repeated in the case that something might go wrong during handling or in the case that the anatomy of the ear changes in size and geometry as it is often the case with children in pediatric applications. Benefits for the hearing care professional (HCP) comprise but are not limited to additional business opportunity, simple process of customization that does only need a heating source but no special skills, etc. While not shown, the same benefits can apply to customizing the cable for connecting the hearing device body 18 to a receiver in the ear canal.

FIGS. **2*a*-2*b* schematically depict a method of customizing an earpiece 30 in an aspect of the present invention. The present invention provides a successful fitting of a BTE or RIC device, including but not limited to high wearing comfort from the start, a correct fit in the ear canal with appropriate acoustic seal and retention, optimal aesthetics for high cosmetic appeal, etc. Depending on the type of hearing device and depending on the hearing loss, different styles and types of earpieces 30 can be offered to the user. The main differentiation between earpieces is the shaping or rather customizing of the earpiece 30** to the ear.

In the prior art, a differentiation can be made between instant fit (e.g. domes) which are ready to use at the point of sale (POS) and custom-fit which are individually manufactured according to the impression taken from the users' ear and manufactured at an external shop requiring a couple of days of processing time. Most customized earpieces are used for moderate to severe or profound hearing losses. There are also custom products for mild to moderate hearing losses (e.g. so-called Slim Tips) which have a large venting. Mild and moderate hearing losses are typically fitted with an instant-fit silicone dome. The advantage of instant-fit silicone domes is that they are ready to use at the point of sale (POS) whereas the customized earpieces require an impression of the users ear, a couple of days for manufacturing and a re-visit of the user at the point of sale (POS).

Commonly, the process of getting a customized earpiece is time-consuming and expensive since first an ear impression needs to be taken, from which a customized earpiece is manufactured, requiring a couple of days of work. After a couple of days, the patient comes back to the shop to pick up the customized earpiece. Ideally, it fits in the first go. If not, the earpiece needs to be modified again requiring the patient to come back again. Therefore, on-site customization would be a great advantage.

The present invention provides a method for on-site, in-situ customization of an earpiece 30 at the point of sale (POS) to be used with e.g. an RIC hearing device. Further provided is a method for improving instant fit silicone domes used e.g. for BTE and RIC instruments, etc.

Figure 2B:
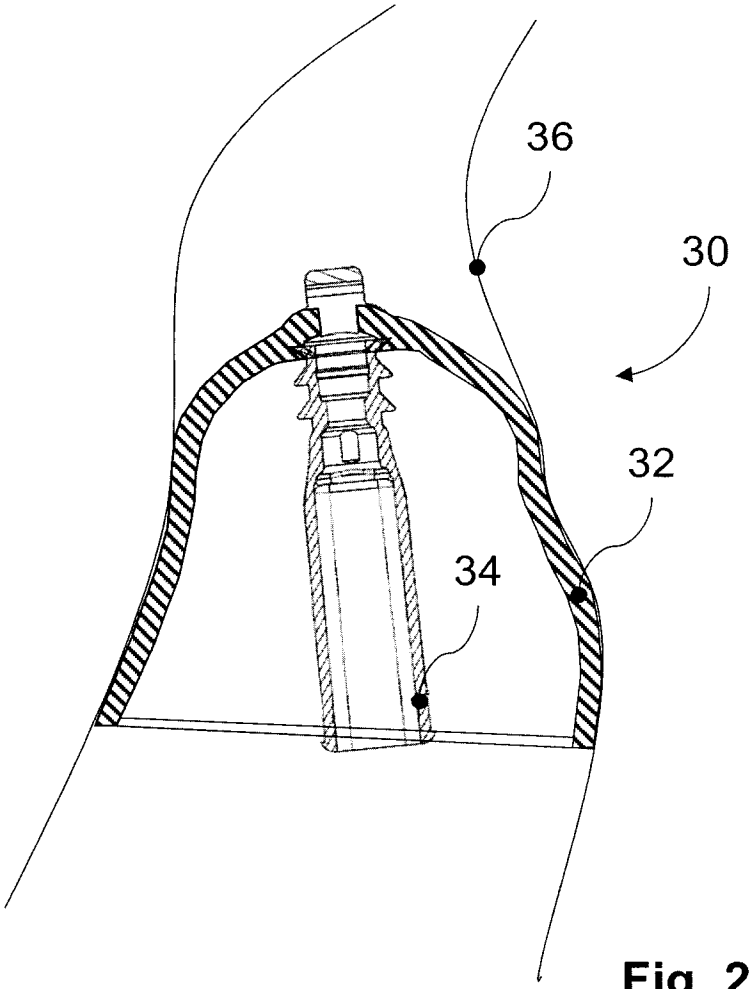
FIGS. 2*a*-2*b* schematically depict a method of customizing an earpiece according to an aspect of the present invention.
Figure 2A:
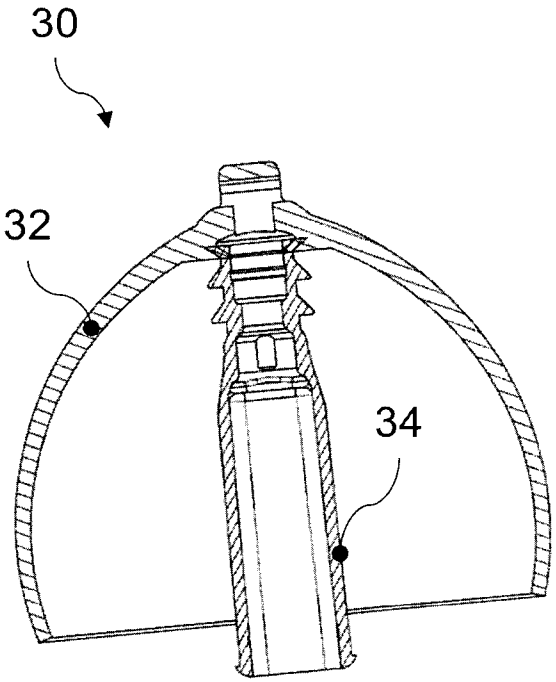

In the following, the invention is described in more detail with regard to the FIGS. 2*a*-2*b*. The earpiece 30 comprises a hollow shell 32. Further, the earpiece 30 can comprise a receiver 34 of the hearing device. The shell 32 is made of the shape-memory material. The earpiece 30 made of the shape-memory material can be offered in a generic geometry and in a limited number of different sizes (e.g. S, M, L). The in-situ customization is based on the material property of the shape-memory material involving the fact that the material softens at elevated temperature and stays soft for a while after having cooled down to room temperature (refer to the above). In the method of customizing, the earpiece 30 is exposed to a temperature cycle with a peak temperature above the softening temperature (i.e. first transition temperature). After cooling down to room temperature, when the earpiece material is still soft, the earpiece 30 is inserted into the users' ear canal 36. While placing the earpiece 30 at the correct position in the users' ear canal 36 the earpiece 30 adapts to the shape of the users' ear canal 36 (refer to FIG. 2*b*). For a better fit, an earpiece shell 32 slightly larger than the ear canal size shall be chosen in order to be able to adjust to the proper size. While staying in the users' ear canal 36, the shape-memory material returns to its original stiffness fixing the enforced shape such that the shell 32 of the earpiece 30 keeps this new shape even after removal of the earpiece 30 from the ear canal 36. Unless the material is exposed to another temperature cycle, the earpiece 30 keeps the individual shape corresponding to a customized earpiece. The customized earpiece can be a tip of an In-The-Ear (ITE) hearing device as e.g. illustrated in FIG. 11 described in the following.

In the method explained above in relation to FIGS. 2*a*-2*b*, after insertion in said ear canal 36, the shell 32 of the earpiece 30 conforms to the individual shape of the ear canal 36 by letting the shell 32 autonomously reconfigure to the shape of said ear canal 36 under restoring force.

In another aspect, the conformal adaptation of said earpiece 30 to said ear canal 36 can be enhanced by additionally providing a restoring force by means of e.g. expandable means forcing the shape-memory material to expand.

Figure 3B:
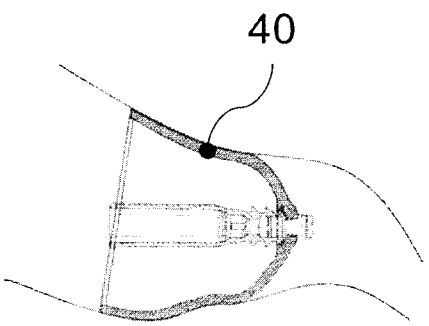
FIGS. 3*a*-3*b* schematically depict a method of customizing an earpiece by using a foam piece according to an aspect of the present invention.
Figure 3A:
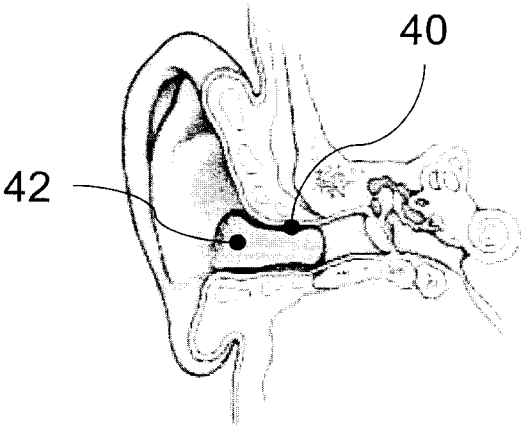

In this regard, FIGS. 3*a*-3*b* schematically depict a method of customizing a shell 40 of an earpiece comprising shape-memory material, as mentioned above, further by using an expandable means comprising a foam piece 42 for allowing improved adjustment to the ear canal. The foam piece 42 can have a slow reset force. In this method, the shell 40 is heated and subsequently cooled down to room temperature such to assume its malleable condition. The foam piece 42 with e.g. a slow reset force is then compressed by e.g. a fixture or rolling it between the fingers. Subsequently, the foam piece 42 is inserted into the malleable shell 40. Both the shell 40 and the inserted foam piece 42 are inserted into the ear canal as can be seen in FIG. 3*a*. Since the reset force of the foam piece 42 is slow, there is enough time to plug in the foam piece 42 into the pliable shell 40 and then insert it into the ear canal. Once inserted into the ear canal, the foam piece 42 expands and forces the shell 42 to adjust to the ear canal as can be seen in FIG. 3*b* and to fix the shell 42 while hardening against the ear canal by attending the hardening time of the shape-memory material. After hardening, the shell 42 is removed from the ear canal. The foam piece 42 could also have a connector which can be fixed to the customizable ear shell 40 after compressing it, for better handling. The foam piece 42 could also have a receiver dummy inside to ensure enough space for the receiver. The foam piece 42 could be disposable or reusable. Triggering the shape-memory material such to soften can be performed by using heat, (heated) water or a combination thereof. For the case of (heated) water as only trigger, an expansion mechanism as mentioned can be needed.

Figure 4C:
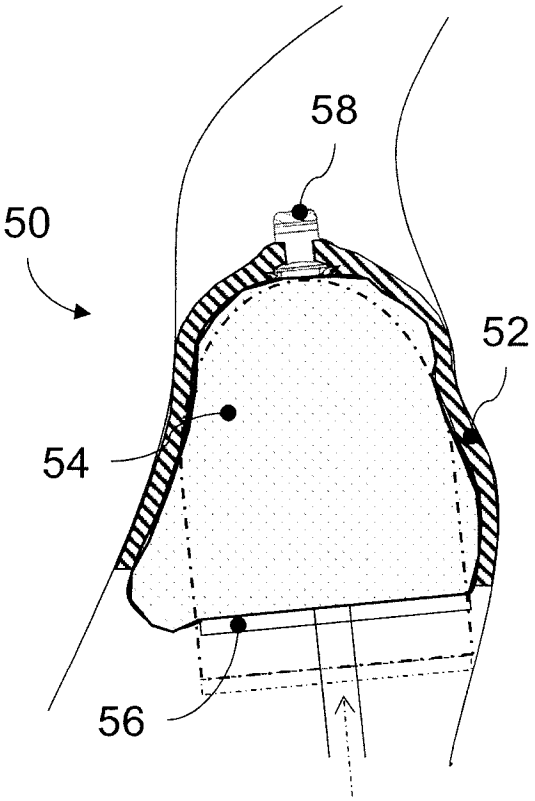
FIGS. 4*a*-4*c* schematically depict a method of customizing an earpiece by using a foam piece according to a further aspect of the present invention.
Figure 4B:
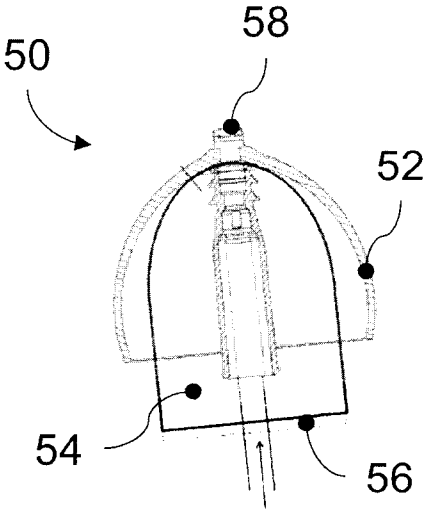
Figure 4A:
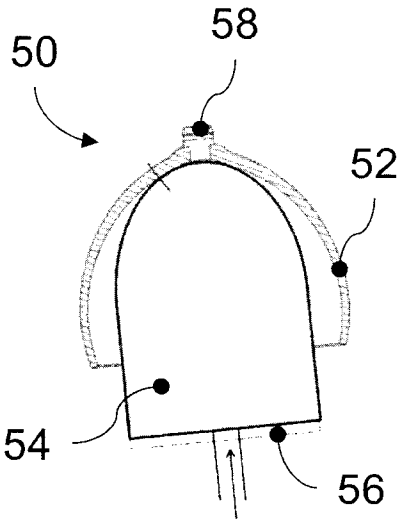

In another example, as shown in FIGS. 4*a*-4*c*, an earpiece 50 comprises a shell 52 made of shape-memory material. The shell 52 in its malleable condition (refer to the above) receives a foam piece 54 having a dome-like design. This foam piece 54 is deformed or rather deformed by pushing a platform 56 and thus applying a mechanical force to the foam piece 54 in a direction as indicated by an arrow in the figures. Then the foam piece 42 expands and applies pressure to the pliable shell 52 such to force it to adjust or rather expand to the ear canal as shown in FIG. 4*c*. After curing, the shell 52 is removed from the ear canal. The foam piece 54 could also have a connector 58 which can be fixed to the customizable ear shell 52 after compressing it, for a better handling. As best seen in FIG. 4*b*, the foam piece 42 could also have a receiver dummy 59 inside to ensure enough space for a receiver (intended receiver) in a later stage.

Figure 5B:
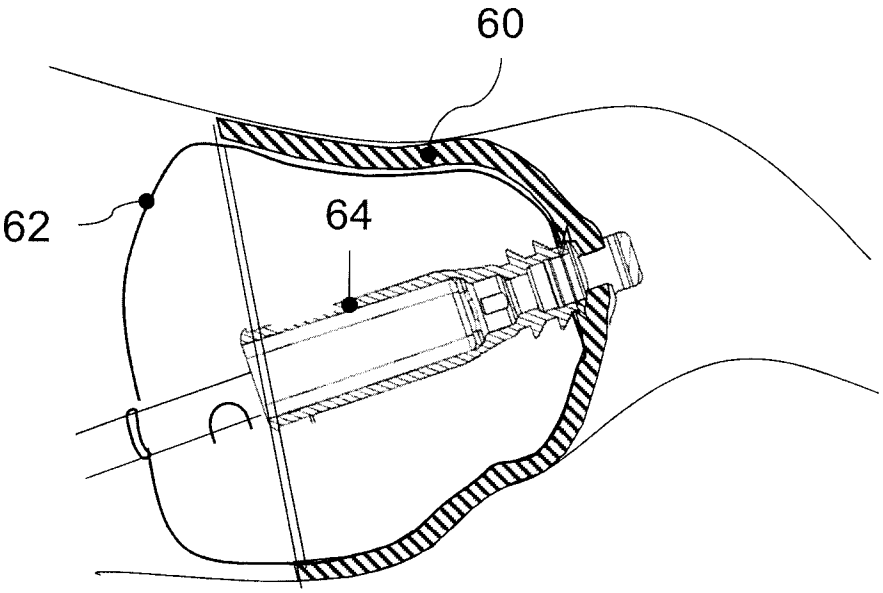
FIGS. 5*a*-5*b* schematically depict a method of customizing an earpiece by using an inflatable balloon according to an aspect of the present invention.
Figure 5A:
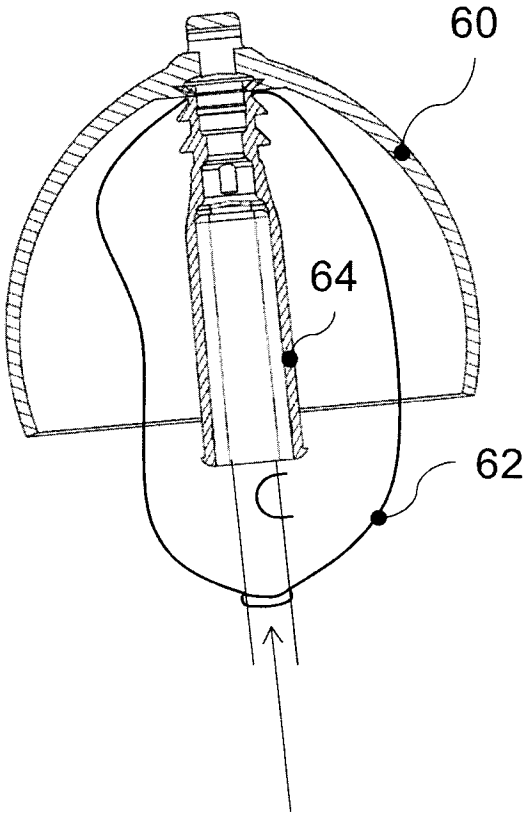
Figure 6A:
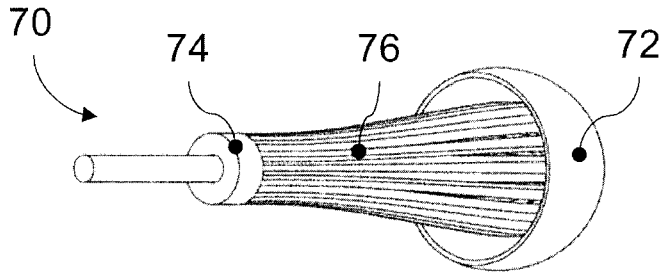
FIGS. 6*a*-6*d* schematically depict a method of customizing an earpiece by using a spring-like mechanism according to an aspect of the present invention.
Figure 6B:
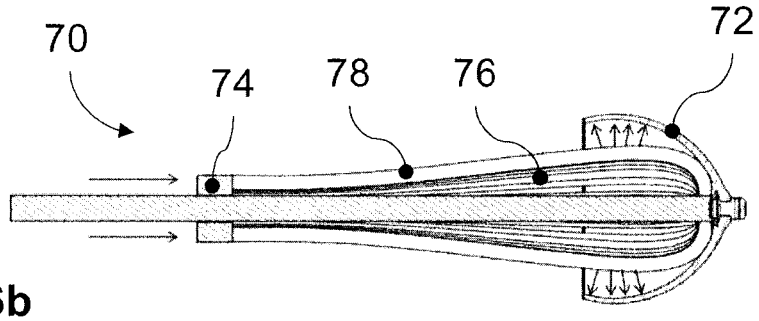
Figure 6C:
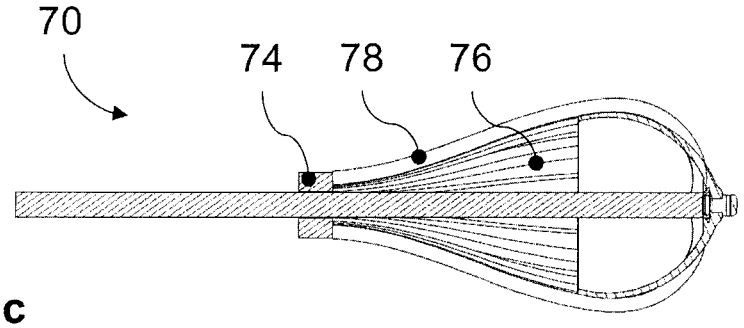
Figure 6D:
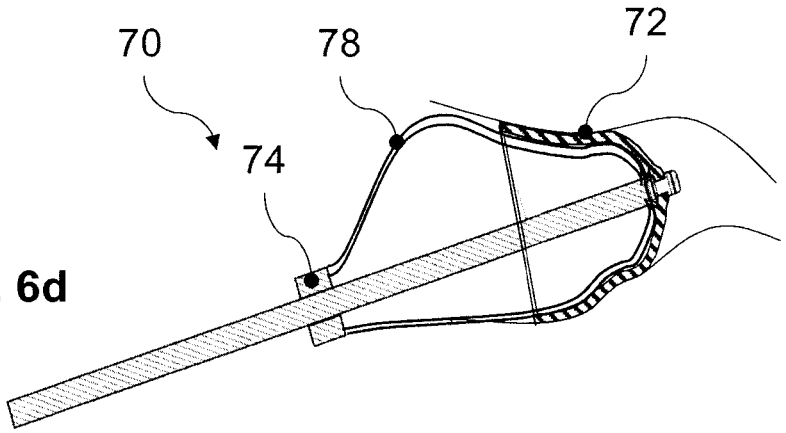

FIGS. 5*a*-5*b* show a method of expanding an ear shell 60 placed into the ear canal in a further aspect of the invention. In this method, the shell 60 can be expanded by means of an inflatable balloon 62 which might be plugged into a connector of the customizable earpiece. By inflating the balloon 62, the pliable ear shell 60 adjusts to the shape of the ear canal while curing. This method comprises heating the shell 60 and cooling it down to room temperature such to assume the malleable condition; receiving the inflatable balloon 62 into the pliable ear shell 60; positioning the shell 60 into the ear canal; once positioned, inflating the balloon 62 with air or fluid in order to apply forces to the pliable ear shell 60; letting the shell 60 harden and removing it from the ear canal once hardened. The inflating liquid could be adjusted to a certain temperature in order to accelerate curing. A receiver dummy 64 could be inserted inside of the inflatable balloon 62 in order to ensure enough space for a receiver in a later stage.

A further method of expanding a shell 72 of an earpiece such to precisely follow the contour of the ear canal is shown in FIGS. 6*a*-6*d*. This method uses a mechanical spring-like mechanism 70 or «Flexible lamella» mechanism, which is used to adapt the customizable shell 72 to the ear canal. After activating the spring-like mechanism 70 inside the ear canal, the shell 72 in its pliable condition is adjusted to the contour of the ear canal and hardened.

The method comprises the step of heating the shell 72 and cooling it down to room temperature; engaging the distal end of the spring-like mechanism 70 with the ear shell 72 disposed in its malleable condition; positioning of the shell 72 into the ear canal; pushing a ring 74 of the spring-like mechanism 70 such to activate the expanding mechanism in a direction as indicated by an arrow in the figures. Alternatively, a non-shown release spring mechanism can be activated in order to apply forces to the pliable ear shell 72. Subsequently, the shell 72 is allowed to cool-down such to harden inside the ear canal. Once hardened, the customized shell 72 is removed from the ear canal.

The spring-like mechanism 70 contains a spring-like element 76 which can comprise a spring, a torsion spring or a flexible element, e.g. made from a flexible plastic or metal. In operation, the spring-like element 76 applies forces to the pliable shell 72. The spring-like element 76 can be covered by a cover 78 in order to avoid damaging of the shell 72 and/or to protect the sensitive ear canal. The spring-like mechanism 70 can also be a combination of flexible and stiff parts, which are connected with joints, in order to improve the adjustment to ear canals with different shapes, e.g. depending on the diameter, etc. While the stiff parts ensure to apply enough force, the flexible parts adjust to the shape of the ear canal and distributes the applied force evenly to the surface of the ear canal. The spring-like mechanism 70 can either be pre-stressed and released inside of the ear shell 72 or relaxed and stressed by a certain movement in order to activate it inside the ear shell 72. In case of the spring-like element 76 comprises the torsion spring, said torsion spring could be stressed and expanded by a twisting movement (not shown).

It is to be noted that the various mechanisms described above which can be used to inflate the shell while hardening, could also be a part of the customizable shell itself and remain in the shell after hardening. Such a customizable earpiece with integrated spring mechanism could be manufactured by insert-injection molding or be assembled.

Figure 7C:
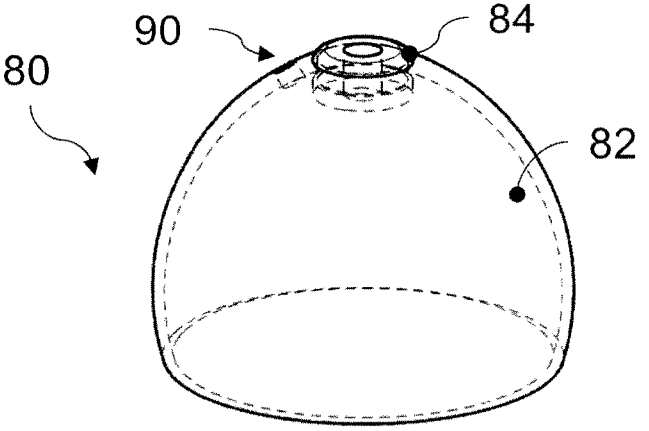
FIGS. 7*a*-7*d* schematically depict earpieces in an aspect of the present invention.
Figure 7D:
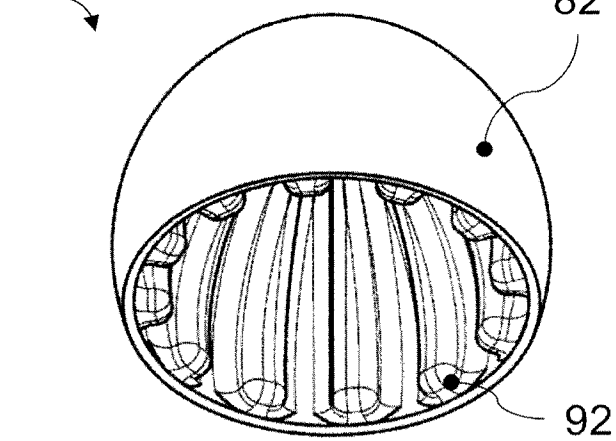
Figure 7B:
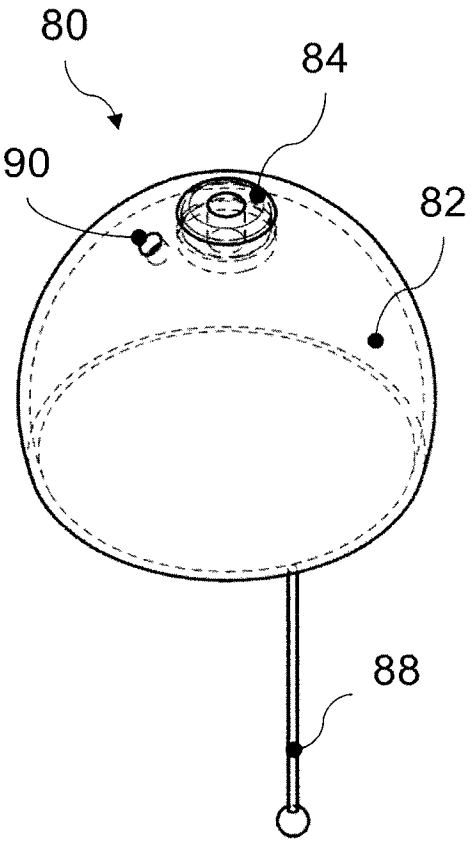
Figure 7A:
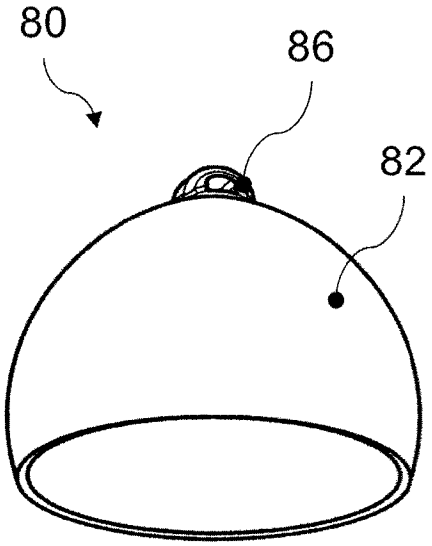

FIGS. 7*a*-7*d* show customizable pre-forms 80 in different views according to different aspects of the invention. The pre-forms 80 comprise an ear shell 82 made of a shape-memory material. In one aspect, as shown in FIGS. 7*b*-7*c*, the pre-form 80 comprises a connector 84 which could be integrated into the ear shell 82 by 2-component-injection molding, gluing, mechanical interlocking, etc. This connector 84 could be made from any hard or soft plastic and involves features to mount an external receiver of a RIC device, a sound tube, a wire or a mechanism for inflating the customizable earpiece while shaping (not shown). Optionally, as shown in FIG. 7*a*, the pre-form 80 comprises a cerumen protection system 86. The cerumen protection system 86 could be integrated in the design of the customizable ear shell 82. Alternatively, the cerumen protection system 86 could be clicked into the connector which is integrated in the ear shell 82 (refer to FIGS. 7*b*-7*c*). While the ear shell 82 is made from a shape-memory polymer, the connector 84 is not necessarily made from the same material as mentioned above. In the case where the connector is made from a polymer without a shape-memory effect it will not change its mechanical properties significantly when the pre-form 80 is heated above the first transition temperature to reach a pliable state. This has the advantage, that any retention mechanism designed into the connector (e.g. an interlock or press-fit or catch mechanism) will still work and allow to connect a sound tube receiver 34 or RIC assembly to the pre-form 80 even in its pliable form.

A removal line 88 could be integrated or glued into the customizable pre-form 80 (refer to FIG. 7*b*). During fitting, an acoustician can determine the optimal position of the removal line 88 while inserting the pre-form 80 into the ear canal. While not shown, the pre-form 80 can comprise a left/right marking in order to mark the earpieces for the left and right ears. In one example, a color code could be used. In this case, color particles could be added to the shape-memory material of the shell 82. In another example, the pre-form 80 could be labelled by printing a label onto the shell 82 of the pre-form 80 or by the provision of a connecting piece, e.g. a plate with a color code which can be clicked to the pre-form 80. A vent 90 could be integrated into the customizable pre-form 80 in order to allow venting. A detailed description thereof will be provided in the following. The customizable pre-form 80 could also comprise scallops 92 (refer to FIG. 7*d*) integrated into the inside of the shell 82, such to improve the adjustment thereof to the customers ear canal during in-situ customization and/or during wear.

Figure 8C:
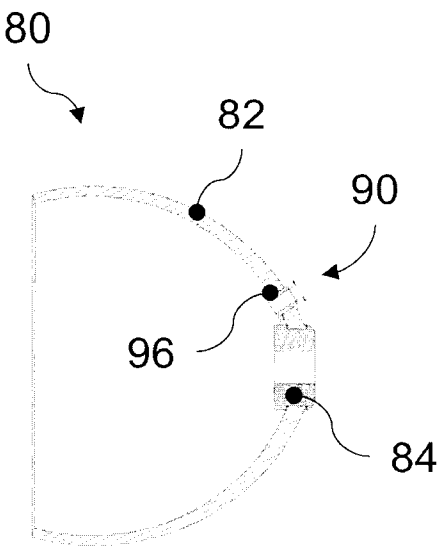
FIGS. 8*a*-8*c* schematically depict an earpiece in an aspect of the present invention.
Figure 8B:
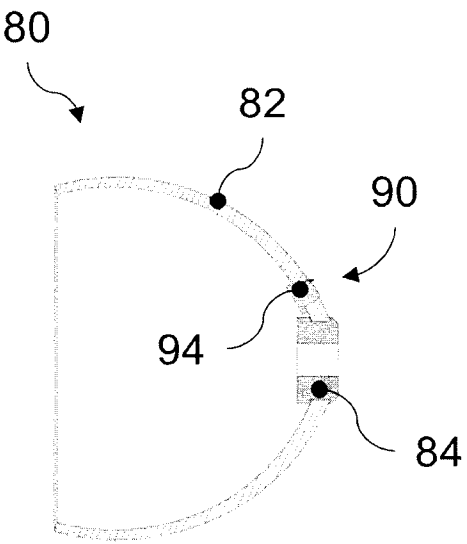
Figure 8A:
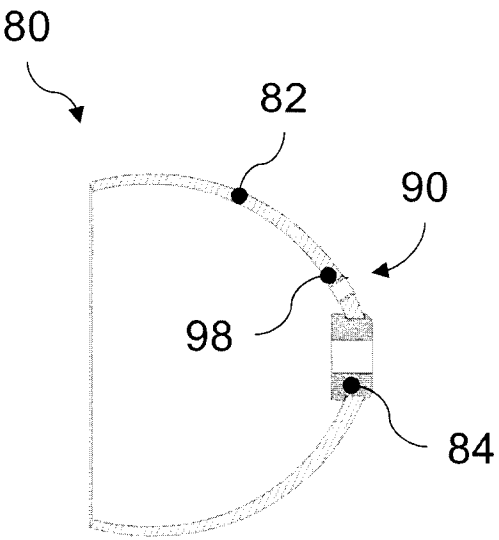

FIGS. 8*a*-8*c* show the customizable pre-form 80 (as shown e.g. in FIGS. 7*b*-7*c*) in cross-sectional views. As mentioned above, the pre-form 80 can comprise the vent 90 in order to allow venting. During manufacturing of the pre-form 80, the vent 90 could be integrated while molding the shell 82. The vent 90 could be closed with a plug 94 (refer to FIG. 8*b*) while shaping the customizable pre-form 80 in order to avoid that the vent 90 will be closed due to deformations. Alternatively or as an option, an insert 96 could be used to integrate different vent diameters (refer to FIG. 8*c*). The vent 90 could also comprise a tube 98 (refer to FIG. 8*a*) which could comprise a hard or soft plastic material. The tube 98 can be adapted to keep its shape while heating and forming the customizable pre-form 80, thereby omitting that the vent 90 will be closed due to deformations.

FIGS. 9*a*-9*e* show the customizable pre-form 80 in different shapes. The pre-form 80 can be shaped e.g. in a bell-shape (refer to FIG. 9*a*) or a balloon shape (refer to FIG. 9*b*). The pre-form 80 could also have a free-form surface (refer to FIG. 9*c*). Further, the pre-form 80 could be rotation-symmetric (refer to FIG. 9*d*) or elliptical (refer to FIG. 9*e*).

Heating the pre-form 80 above the first transition temperature could be done by placing the component into hot water for several minutes. If the pre-form 80 is preassembled to a sound tube or a RIC cable at this point, a removable plug (not shown) can be placed into the sound opening of the pre-form 80 or into the medial end of the connector 84 in order to prevent water from entering the sound tube or RIC assembly. Once removed from the hot water the plug can be removed thus leaving the sound opening free.

Figure 10C:
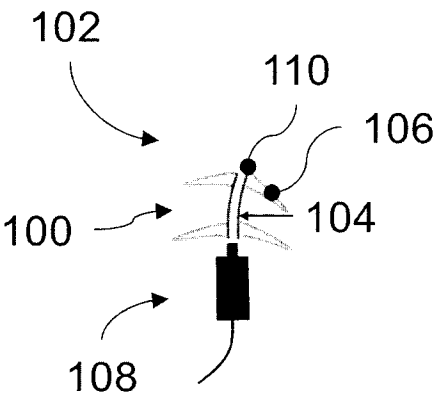
FIGS. 10*a*-10*c* schematically depict a method of customizing a dome of an earpiece.
Figure 10B:
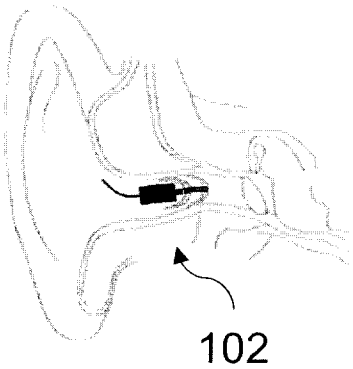
Figure 10A:
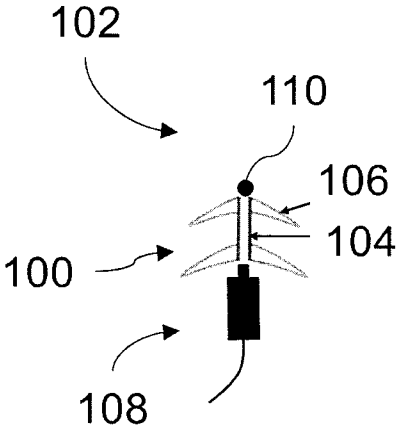

FIGS. 10*a*-10*c* schematically show a method of customizing a dome 100 of an earpiece 102. The dome 100 can be an instant-fit part of the earpiece 102 comprising a cylindrical tube 104 with e.g. one or two flaps 106 arranged concentrically around said tube 104. The dome 100 can fulfil mechanical and acoustical functions. The mechanical function of a dome 100 is to position a receiver 108 and/or an outlet 110 of the sound tube 104 in the ear canal. Depending on the hearing loss the dome 100 also has an acoustic function. For severe and profound hearing losses the dome 100 seals the ear canal with the flaps 106 against the noisy environment (also referred as Power Dome). For moderate and mild hearing loss no complete sealing of the ear canal is needed and a more open structure of the dome 100 can be used (also referred as closed or open dome).

In an aspect of the present invention, a method is provided allowing an in-situ customization of the dome 100 at the point of sale (POS) such to improve the wearing comfort of the dome 100. Thereby, a connector part can be elongated beyond a connector forming the cylindrical tube 104 to which the flaps 106 are concentrically arranged. The cylindrical tube 104 is made of the shape-memory material (e.g. Desmopan DP 2795A SMP) whereas the flaps 106 can be made of a soft silicone and are connected to the shape-memory material of the cylindrical tube 104 by means of e.g. a 2 component injection molding process. A schematic image of such a dome 100 is shown in FIG. 10*a*.

During customization, the dome 100 made of the shape-memory material is exposed to a temperature cycle with a peak temperature above the softening temperature, i.e. the first transition temperature. After cooling down to room temperature the dome 100 will be inserted in the users' ear canal, as depicted in FIG. 10*b*. While placing the dome 100 at the correct position in the users' ear canal the tube 104 adapts to the shape of the users' ear canal, as can be seen in the FIG. 10*b*. While staying in the users' ear canal the tube 104 returns to its original stiffness fixing the enforced shape also when removing the dome 100 from the ear canal, as depicted in FIG. 10*c*. Unless the material is exposed to another temperature cycle, the tube 104 of the dome 100 keeps the individual shape corresponding to a customized dome 100.

Therefore, the dome 100 best adapts to the anatomy of the users' ear canal. As a result, since individually scaled or rather customized with the anatomy of the ear canal, i.e. size and geometry, the dome 100 exerts no pressure on the wall of the ear canal. Thus, the wearing comfort is highly improved.

Several of a plurality of benefits for the user resulting from the in-situ customization are increased comfort and fit of the instant fit dome 100 and increased comfort in the course of time, since the user is able to self-adjust the tube 104 if the dome 100 might not sit properly in the course of time.

Figure 11:
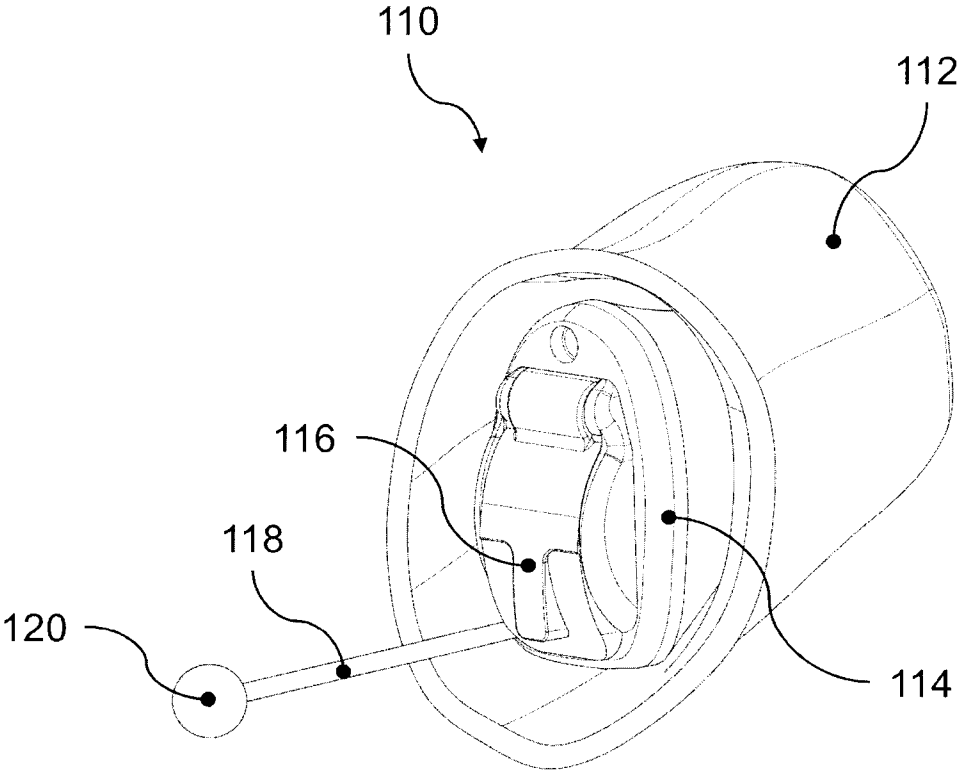
FIG. 11 schematically depicts an In-The-Ear hearing device with a customized tip.

As referenced in the above, FIG. 11 shows a customized earpiece configured as a tip 110 of an In-The-Ear (ITE) hearing device. The customized tip 110 comprises a customized shell 112 and a standard-sized (non-custom) hearing device module 114 inserted into the customized shell 112. The hearing device module 114 comprises all the necessary components of a hearing instrument in a non-custom housing. Those components comprise at least one microphone, a signal processing unit, a power supply including primary or secondary batteries with the respective charging means and a receiver for sound output. Additional elements such as antennas or coils for communication with other devices or user controls such as push buttons or volume controls might also be included in the hearing device module 114.

The shell 112 is customized according to at least an aspect of the present invention. This allows that the shell 112 perfectly conforms to the individual shape of the ear canal, allowing successful fitting, including but not limited to high wearing comfort from the start, a correct fit in the ear canal with appropriate acoustic seal and retention, optimal aesthetics for high cosmetic appeal, etc. The main advantage over for a user of such a hearing aid is that he or she can be custom-fitted at the point of sale (POS) and can walk out the shop with his or her device working and immediately experience the benefits of a hearing aid while today it can take several days for a custom-made hearing aid to be manufactured and shipped back to the POS for the customer to pick up. Alternatively the customization could be done by the user at home if the hearing aid is purchased in a retail store or online. The hearing device module 114 of the tip 110 comprises a battery compartment which is easily accessible from the outside by simply opening a battery compartment door 116. In order to allow for proper insertion into and removal from the ear canal, the tip 110 is further provided with a removal line 118 extending to the outside. The removal line 118 is provided with a bulge 120 at the distal end thereof allowing improved handling of the tip 110 during insertion and removal.

In another example the shell 112 can also be directly the shell of an in-the-ear hearing instrument containing all the components of the hearing device module 114 mentioned above. The advantage of such a design would be, that it can be made smaller, since there is no more need for double walls of the hearing device module 114 and the shell 112. In this example, the pre-form of the hearing device component would be a hearing device containing all the elements above enclosed in a standard sized shell that is customized in shape to an ear of a hearing device user.

The invention claimed is:

1. A method of customizing a component of a hearing device to an ear of a hearing device user, comprising the steps of:

a) providing said hearing device component as a pre-form comprising a shape-memory material having a primary shape;

b) heating said hearing device component beyond a first transition temperature to a malleable condition, wherein said first transition temperature is above 50° C.;

c) keeping said hearing device component unengaged and/or uncoupled with said ear for a time interval sufficient for said hearing device component to cool down to a pre-set contact temperature, while said hearing device component retains said malleable condition;

d) after reaching said pre-set contact temperature, bringing said hearing device component in contact with at least a portion of the ear of said hearing device user such that said hearing device component conforms to the individual shape of said at least a portion of the ear, said shape-memory material keeping a tendency to recover to said primary shape at, and below, said pre-set contact temperature, such that said hearing device component exerts a restoring force on said at least a portion of the ear of said hearing device user to allow for a conformal adaptation of said hearing device component to said at least a portion of the ear of said hearing device user; and e) fixing said shape of said hearing device component by attending a hardening time of said shape-memory material.

2. The method of claim 1, wherein said hearing device component comprises at least one of a retention element, an ear-piece, a sound tube and a cable.

3. The method of claim 1, wherein said first transition temperature is within a range of from above 50° C. to 100° C.

4. The method of claim 1, wherein said pre-set contact temperature is a room temperature or a temperature dependent on the tolerance of the body of said hearing device user.

5. The method of claim 1, wherein the providing step a) comprises the step of:

a1) manufacturing at least a portion of said pre-form of said hearing device component from a shape-memory material, comprising the steps of:

liquefying said shape-memory material by heating it to a temperature above a second transition temperature and shaping it into the primary shape that will become part of said at least a portion of said preform; and solidifying said primary shape upon cooling to a temperature below said given second transition temperature and preferably below said first transition temperature.

6. The method of claim 5, wherein said second transition temperature is in a range of 60° C. to 250° C.

7. The method of claim 1, wherein said time interval upon cooling during which said hearing device component retains said malleable condition is a pre-set time delay to reach said pre-set contact temperature before hardening into a final shape, said pre-set time delay being designed by adjusting the chemical formulation of said shape-memory material and/or by adding nucleation agents or similar to said shape-memory material.

8. The method of claim 7, wherein said pre-set time delay ranges between 30 seconds and 30 minutes.

9. The method of claim 1, wherein bringing said hearing device component in contact with at least a portion of the ear of said hearing device user comprises the step of inserting said hearing device component in an ear canal of the ear of the hearing device user.

10. The method of claim 1, wherein making said hearing device component conform to the individual shape of said at least a portion of the ear comprises the step of letting the hearing device component autonomously reconfigure to the shape of said ear canal under said restoring force, after insertion into the ear canal, at least for a part of the conforming process.

11. The method of claim 1, wherein making said hearing device component conform to the individual shape of said at least a portion of the ear comprises the step of additionally providing said hearing device component with at least one expandable means adapted to enhance a conformal adaptation of said hearing device component to said ear canal.

12. The method of claim 11, wherein said at least one expandable means being removable upon fixing the shape of said hearing device component.

13. The method of claim 1, wherein making said hearing device component conform to the individual shape of said at least a portion of the ear comprises the step of molding and/or pressing the hearing device component into shape by engagement with said ear.

14. The method of claim 11, wherein the at least one expandable means is comprised by the hearing device component.

15. The method of claim 1, wherein the step of fixing the shape of said hearing device component comprises holding said component in place, manually; or by the aid of fastening means configured to attach said component to said at least a portion of the ear.

16. The method of claim 1, wherein the shape into which said hearing device component has been customized after hardening against said at least a portion of the ear of the hearing device user can be further adjusted by repeating steps b) to e) of claim 1.

17. A hearing device component customizable for acoustic coupling to an ear of a hearing device user, wherein said hearing device component is made from a shape-memory material according to the method of claim 1.

18. The hearing device component of claim 17, wherein said hearing device component is an earpiece comprising a seal which comprises a sound output bore connected to a receiver or a sound tube of said hearing device.

19. The hearing device component of claim 18, wherein said seal takes the form of an open-ended sleeve; or the form of a dome-shaped element; or the form of a pre-formed earmold.

20. The hearing device component of claim 17, comprising a sound tube designed to deliver sound emitted by the hearing device to a tympanic membrane of said ear, wherein said sound tube comprises at least one of a sound tubing system, a tubing and wiring system.

21. The hearing device component of claim 17, comprising a retention element adapted to engage with at least an outer ear portion of the ear of said hearing device user and attached to an earpiece of said hearing device arrangeable in an ear canal of said ear, wherein said retention element is configured to bias against movements of said earpiece within said ear canal.

22. The hearing device component of claim 20, wherein the sound tube is individually repositionable for supporting a safe hold of a behind-the-ear part of said hearing device to the ear of said hearing device user.

23. The hearing device component of claim 18, comprising at least one expandable means adapted to enhance a conformal adaptation of said earpiece to said ear canal.

24. The hearing device component of claim 17, wherein said shape-memory material is one of a shape memory polymer, shape memory blend, shape memory composite or a mixture of some of these materials.

25. The hearing device component of claim 17, wherein said shape-memory material is Desmopan DP 2795A SMP.

26. A hearing device comprising at least one hearing device component of claim 17 for acoustic coupling to an ear of a hearing device user.

27. The method of claim 11, wherein said at least one expandable means comprises one of a foam piece, an inflatable balloon, and a spring-like mechanism.

* * * * *